US006315122B1

(12) United States Patent
McCord et al.

(10) Patent No.: US 6,315,122 B1
(45) **Date of Patent: *Nov. 13, 2001**

(54) PALLETLESS PACKAGING SYSTEM

(75) Inventors: Thad Syfan McCord, Greer, SC (US); James C. Wright, Jr., Greensboro, NC (US); Russell Travis Butler, Greenville, SC (US)

(73) Assignee: Mitsubishi Polyester Film, LLC, Greer, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/275,765

(22) Filed: Mar. 24, 1999

Related U.S. Application Data

(63) Continuation-in-part of application No. 09/080,760, filed on May 18, 1998, now Pat. No. 6,073,768

(60) Provisional application No. 60/047,958, filed on May 29, 1997.

(51) Int. Cl.[7] ..... B65D 85/66

(52) U.S. Cl. ..... 206/408; 206/413; 206/600

(58) Field of Search ..... 206/389, 397–403, 206/412, 509, 595, 598, 600, 386, 413, 415, 416; 220/1.5; 108/55.1, 54.1; 410/48, 49, 50

(56) References Cited

U.S. PATENT DOCUMENTS

| | | | | |
|---|---|---|---|---|
| 4,027,794 | * | 6/1977 | Olson | 206/403 |
| 4,151,914 | * | 5/1979 | Blatt | 206/408 |
| 4,217,984 | * | 8/1980 | Magnuson | 206/403 |
| 4,877,133 | | 10/1989 | Klenter et al. . | |
| 5,094,346 | * | 3/1992 | Sommerfeldt et al. | 206/600 |
| 5,205,411 | | 4/1993 | Born et al. . | |
| 5,287,816 | | 2/1994 | Jungpeter et al. . | |
| 5,344,013 | | 9/1994 | Born et al. . | |
| 5,431,282 | | 7/1995 | Kremp et al. . | |
| 5,704,479 | * | 1/1998 | Barnett et al. | 206/396 |
| 5,735,219 | * | 4/1998 | Kirker et al. | 108/55.1 |

* cited by examiner

*Primary Examiner*—Luan K. Bui

(57) ABSTRACT

An end plate for supporting roll goods incorporating a vertical plate having a channel therethrough, the channel extending from a top edge of the vertical plate to a point separated from a bottom edge of the vertical plate; and a foot member extending from the vertical plate at the bottom edge, the foot member enhancing the stability of the end plate. A packaging system including at least one end plate and a core adapted to be lowered into the channel is also disclosed, as is a method of packaging roll goods using such end plates and packaging systems.

48 Claims, 4 Drawing Sheets

PALLETLESS PACKAGING SYSTEM

CROSS-REFERENCE TO RELATED APPLICATIONS

This application is a continuation-in-part of U.S. patent application Ser. No. 09/080,760, filed May 18, 1998, U.S. Pat. No. 6,073,768 which is related to U.S. Provisional Patent Application No. 60/047,958, filed May 29, 1997.

BACKGROUND OF THE INVENTION

1. Field of the Invention

The invention disclosed herein relates generally to a palletless packaging and transport system for wide-web roll products. More specifically, the present invention relates to the use of footed endplates as support and packaging for roll goods. These footed endplates reduce or eliminate the need for conventional wood palleting structures. According to one embodiment of the present invention, the footed endplates are used in conjunction with a stabilizer to form a stationary palletless packaging system.

2. Description of Related Art

Conventional pallets are well known and widely used for the transport of roll goods and other types of goods. These pallets are typically formed as wooden platforms, to which vertical supports for supporting roll goods can be affixed. Multiple pallets can then be stacked one upon another to maximize the volume of goods that can be transported or stored in trucks and warehouses. Each pallet structure requires a substantial amount of lumber, which is expensive and only partially reusable. Moreover, most pallet structures include multiple wooden layers to provide sufficient strength to the packaging assembly, and to allow the pallets to be engaged by forklifts and other similar equipment. Conventional pallets are also very heavy. Both the safety and the cost of transportation and storage are reduced as the weight of packaging materials is reduced. Accordingly, it would be desirable to provide an improved packaging system that reduces or eliminates the need for conventional heavy wooden pallets.

BRIEF SUMMARY OF THE INVENTION

Thus, it is an object of the present invention to provide a packaging system that needs no conventional pallet.

It is a further object of the present invention to provide a packaging system that uses no wood, or less wood than conventional packaging.

It is yet another object of the present invention to provide a recyclable packaging system.

It is yet another object of the present invention to minimize contamination of the goods being packaged by eliminating the pallet.

It is a further object of the present invention to provide endplates for roll goods having enhanced stability, standing alone, in pairs, and when stacked.

It is another object of the present invention to provide endplates that do not require interlocking for stability when stacked.

It is another object of the present invention to provide endplates that are adapted for use on conveyor belt transport systems.

It is a further object of the present invention to provide endplates that are adapted for use in conjunction with baseplate stabilizers, such as T-shaped and L-shaped stabilizers.

It is another object of the present invention to provide an adjustable packaging system that easily conforms to roll goods of varying lengths and thicknesses.

It is yet another object of the present invention to provide a packaging system for roll goods that is of lighter weight than conventional packaging systems.

It is a further object of the present invention to provide a packaging system that is easy to assemble and disassemble. Such a packaging system uses fewer or no invasive affixing means, such as screws, nails or staples, which are time consuming to apply and remove, and which limit the number of times a single system can be used.

In furtherance of these objectives, the present invention provides an end plate for supporting roll goods including a vertical plate having a channel therethrough, the channel extending from a top edge of the vertical plate to a point separated from a bottom edge of the vertical plate; and a foot member extending from the vertical plate at the bottom edge, the foot member enhancing the stability of the end plate. A packaging system including at least one end plate and a core adapted to be lowered into the channel is also disclosed, as is a method of packaging roll goods using such end plates and packaging systems.

DETAILED DESCRIPTION OF THE INVENTION

Figure 1:
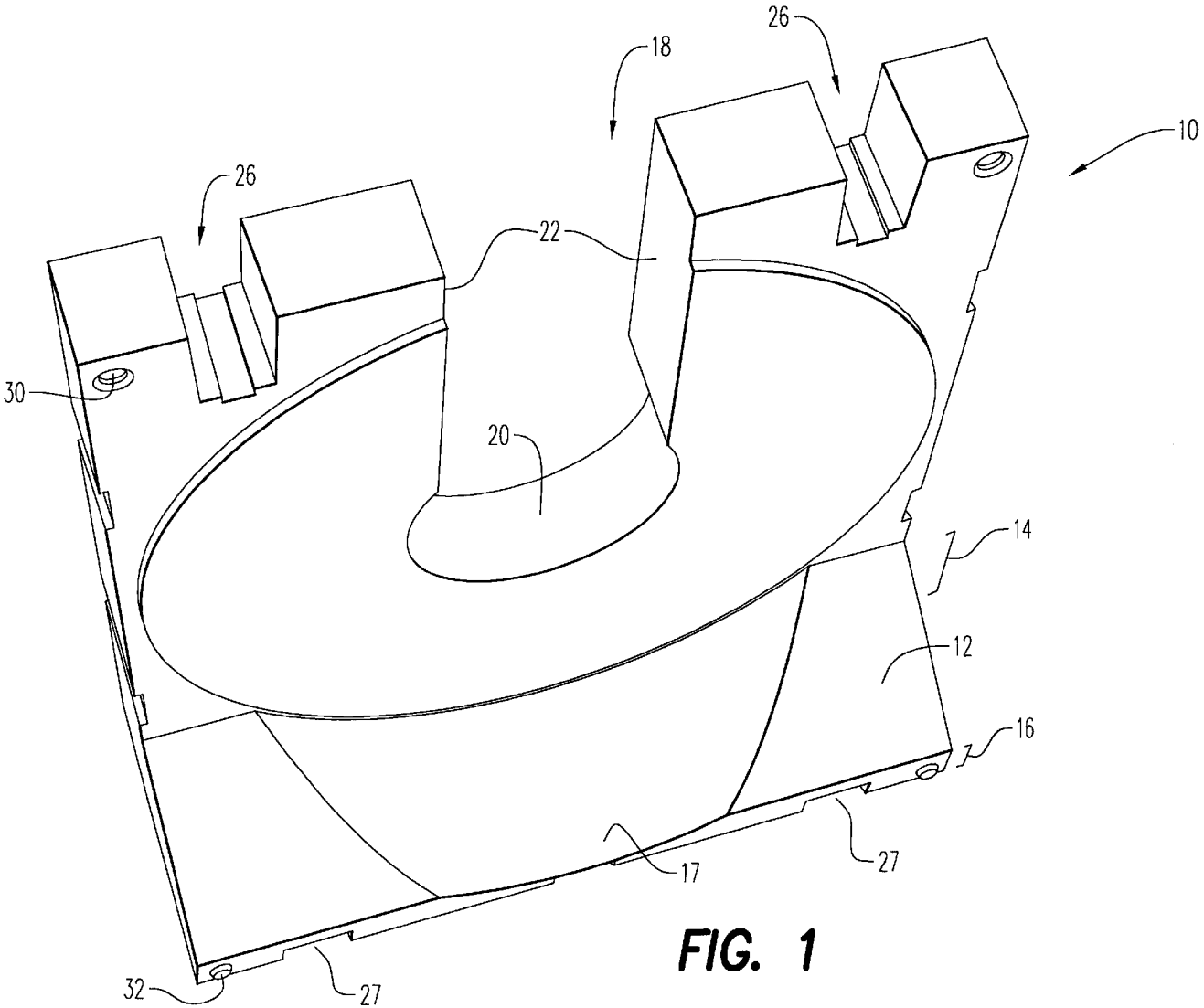
FIG. 1 is a perspective view of a preferred endplate according to the present invention.
Figure 2:
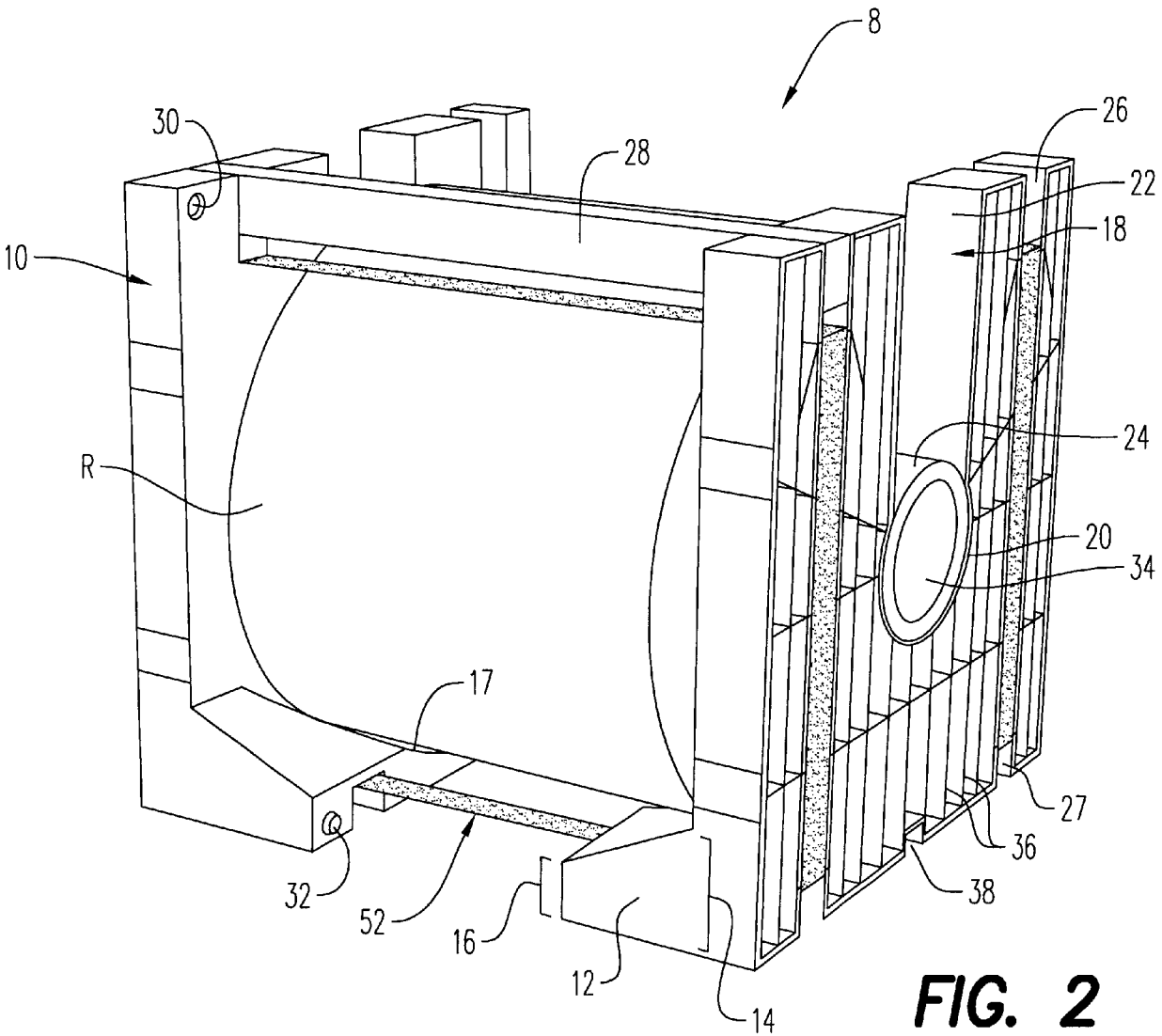
FIG. 2 is a perspective view of a preferred packaging system according to the present invention that incorporates two endplates as shown in FIG. 1.
Figure 3:
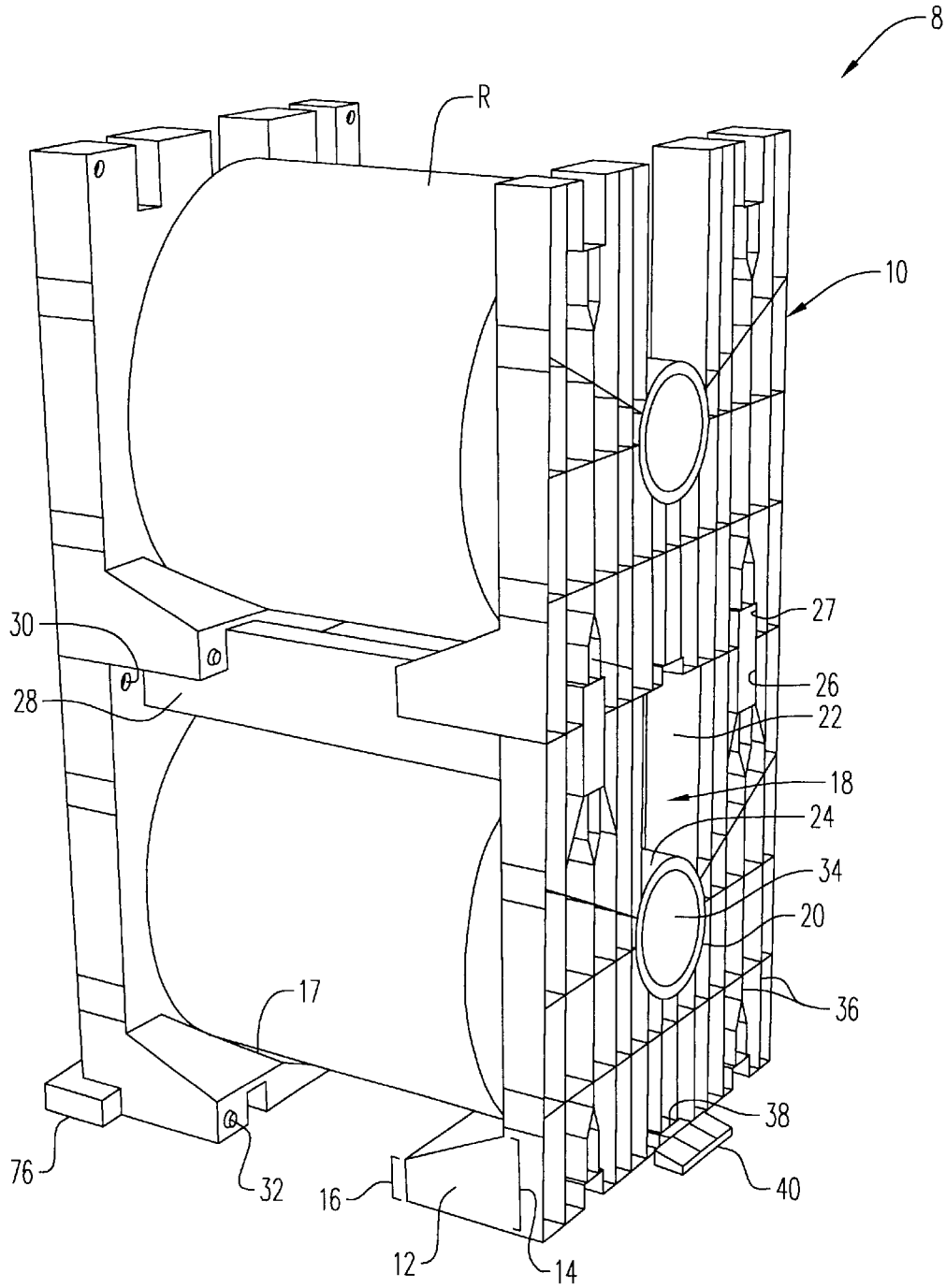
FIG. 3 is a perspective view of a stack of two packaging systems of the type shown in FIG. 2.

The packaging system of the present invention is generally referred to in FIGS. 2 and 3 by reference number 8. Packaging system 8 includes at least one footed end plate 10 that is designed to accept a core about which the rolled goods are disposed. With reference to FIG. 1, a preferred embodiment of end plate 10 is shown. End plate 10 includes elongated foot 12. In this preferred embodiment, foot 12 extends the full width of end plate 10, and tapers evenly at its edges from a first depth 14 to a second depth 16. In the middle of foot 12, a curved indentation 17 is preferably included that decreases the depth of foot 12 to conform to the contours of the maximum-diameter roll goods R that are accommodated without contact in end plate 10. Indentation 17 is preferred because it minimizes the height of end plate 10 (and the volume of unused space that a roll of product will create), as well as the amount of material used to produce end plate 10, and its resulting weight.

Foot 12 makes end plate 10 a viable substitute for traditional pallets. End plate 10 gives end plate 10 the ability to stand upright when standing alone, and provides stability to a packaging system including at least one end plate 10 and a core 24. Foot 12 keeps end plate 10 in substantially perpendicular alignment with core 24, and consequently with the end of the roll goods R being supported. This minimizes the chance that the end of the roll goods R will be bent, crushed or contaminated by contact with end plate 10. Because of the added stability of foot 12, end plate 10 can easily be transported by a conveyor belt or a similar transport systems, whether alone or as part of a packaging system.

Foot 12 preferably extends beyond the end plate a distance about twice the depth of end plate 10. Less preferably, the ratio of the depth of foot 12 to the depth of end plate 10 is about 1:1 to about 3:1. The height of foot 12 is preferably about ⅕ the total height of the end plate 10. Less preferably, foot 12 extends about ⅓ to about ⅙ the height of the end plate 10. Both foot 12 and end plate 10 are preferably formed with internal ribs 36. These ribs provide maximum strength and durability while minimizing the product's weight.

Foot 12 can project from one or both faces of end plate 10. Foot 12 can extend continuously across the width of end plate 10, or can be made up of one or more projections located along end plate 10 that are of sufficient width to provide improved stability to foot 12 and any resulting packaging system. Foot 12 can be tapered or untapered.

End plate 10 also includes a channel 18, which ends in a stop 20. Stop 20 is preferably curved, and more preferably has the shape of an arc section of a circle. It is preferably located in the middle of the width of end plate 10, either horizontally or vertically, or both. Channel 18 preferably includes two substantially parallel sides 22. This configuration is particularly well adapted to accept a core 24 (as shown in FIGS. 2 and 3) of circular cross-section and having a diameter slightly less than the width of channel 18.

The core 24 can be of constant diameter, preferably of a diameter slightly smaller than the width of channel 18. It can be circular, oval, square, octagonal or other shape in cross-section. The core preferably has at least one open end 34, but can also have a closed end or be solid. This open end 34 is preferably sufficiently wide, and otherwise adapted, to receive and engage a support element, such as a forklift rail. Core 24 can also extend beyond the end plate 10 to provide a lifting surface. The core 24 can be made of readily available materials such as paperboard, metal, polymeric materials and such. It is preferred that core 24 be stronger than conventional cores used in traditional palleting structures, so that the packaging system can be lifted by core 24 instead of from underneath, as is conventionally done. Such added strength also allows core 24 to be reused numerous times without being deformed, torn or destroyed. Additional strength can be provided to conventional cores by alternatives well known in the art, including using stronger materials, using reinforcing members within core 24 or in the core material, using laminated, layered materials, using thicker material, or combinations of the foregoing.

Core 24 can optionally include a core insert (not shown), as discussed in the parent application. Core inserts are useful when, for example, core 24 has a larger diameter than channel 18. Such core inserts are preferably hollow cylindrical objects whose outer diameter at one end is larger than the internal diameter of core 24. This end is forced into the core 24. The opposite end of the core insert can then engage with channel 18 of end plate 10.

As seen in FIGS. 1, 2 and 3, end plate 10 furthermore can include notches 26 and 27. Notches 26 are located on the top surface of end plate 10, and are adapted to accept horizontal members 28. These horizontal members can be selected from such sources as synthetic supports (e.g., extruded plastic posts), metal (e.g., hollow aluminum supports), or wood (e.g., lengths of conventional 2×6 or 2×4 lumber, with or without adapters to fit them to the dimensions of notches 26, 27). Horizontal members 28 can be used to provide additional strength and stability to the packaging system, but preferably are used only to protect the roll goods R from accidental contact by shifting packaging systems stacked above or below them. In such case, the stability of the packaging system is provided essentially entirely by the assembly of end plate 10, core 24, and second end plate 10. End plates 10 are held in place by conventional means known in the art. Preferred means include strapping and banding. Nylon, polyester, metal or other types of banding 52, as shown in FIG. 2, can be tensioned to pull end plates 10 firmly against the edge of the film or other roll goods. The banding 52 can then be firmly attached to itself by means of mechanical clips, heat, friction welding or other means, or it can be attached to the end plates, the roll goods or other anchor sites. The banding 52 can nest in notches 26 and 27, permitting consistent spacing and location of the banding straps, and eliminating any abrasion of the banding by adjacent packaging systems.

Notches 27, which are located on the bottom edge of end plate 10, are also adapted to engage horizontal members 28 (for example, from a packaging system underneath, as seen in FIG. 3). This preferred construction provides side-to-side stability for a stack of packaging systems, while permitting some relative movement between packaging systems along the length of horizontal members 28. By permitting such motion, the centers of gravity of each individual packaging system are maintained separate. A stack of packaging systems is less likely to fall due to a force applied along the length of an upper packaging system.

Alternatively, end plates 10 can be formed with conventional engaging tabs or other protrusions (not shown) to permit two or more end plates 10 to be stacked and locked together vertically. Because this would create a single composite packaging system from two or more packaging systems, the center of gravity of the composite packaging system is raised in comparison to the effective base of the packaging system or structures. Consequently, the composite packaging system becomes less stable and more likely to topple during shipment than packaging systems that are not locked together.

However, such an interlocking structure is desirable, for example, where roll goods R having a diameter greater than the width of the end plate 10 are to be carried. By stacking and interlocking three end plates 10 vertically (or alternatively stacking and interlocking nine end plates in a 3×3 grid, using horizontal and vertical interlocking), a core placed in the centermost channel 18 can be accommodated. When an end plate 10 having the inner contours as shown in FIG. 1 is used, the footed face can be turned away from the roll goods R to ensure that no interference exists between foot 12 and the end of the roll goods R.

End plates 10 preferably include recesses 30 and mating buttons 32, or other similar interlocking elements. By use of these interlocking elements, end plates 10 can be packed together in offset pairs when not in use by matching buttons 32 on foot 12 of one end plate 10 to recesses 30 on the opposite end of an inverted second end plate 10. The resulting structure is box-shaped and easy to store and transport.

While a preferred packaging system according to the present invention will include two end plates 10, it is also envisioned that a single end plate 10 can be used in conjunction with another end support. For example, core 24 can be mounted at a first end on permanent or temporary supports located on a truck or in a warehouse. A notched rail or other compatible bracket can be used as the first end support. A single end plate 10 can then be used to support the second end of core 24. Alternatively, depending on the location and orientation of the product being supported by the packaging system of the present invention, one or more supplemental end plates 10 can be situated along core 24 as further support or protection for the roll goods R. For example, if two narrow webs are wound on a single core 24 at an offset from each other, an end plate 10 can be centered between the two narrow webs to provide strength, stabilization and protection in the middle of the length of core 24.

In a preferred embodiment according to the present invention, end plate 10 can be formed with a center notch 38. As shown in FIG. 3, center notch 38 is adapted to engage a baseplate stabilizer 40, such as the T-shaped block stabilizer disclosed in copending parent U.S. patent application Ser. No. 09/080,760, filed May 18, 1998, the disclosure of which is incorporated herein in its entirety by reference. Most preferably, this baseplate stabilizer 40 is not attached to a conventional wooden pallet, as preferred therein, but is instead removably affixed to a truck platform or warehouse platform. As seen in FIG. 3, the baseplate stabilizer 40 then engages endplate 10 and its packaging system, and ensures that endplate 10 remains stationary during transport or storage.

Figure 4:
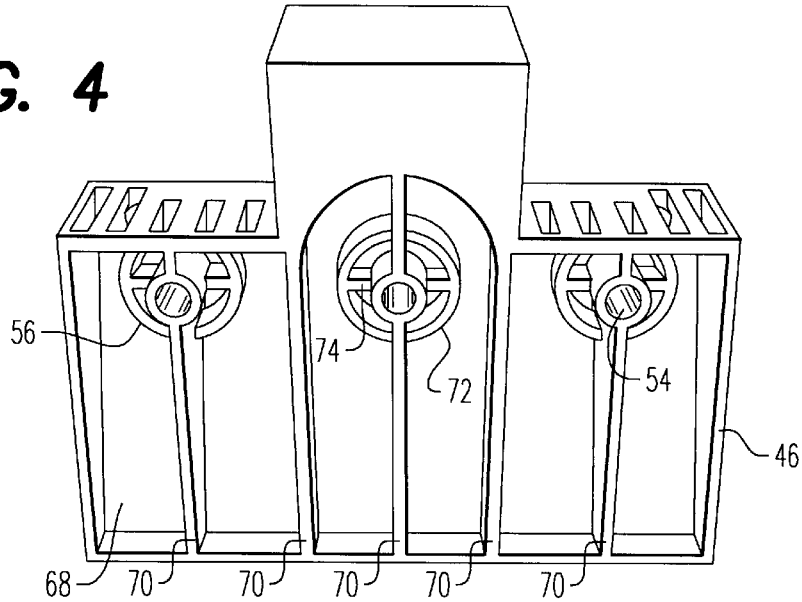
FIG. 4 is a bottom perspective view of a preferred baseplate stabilizer according to the present invention.
Figure 5:
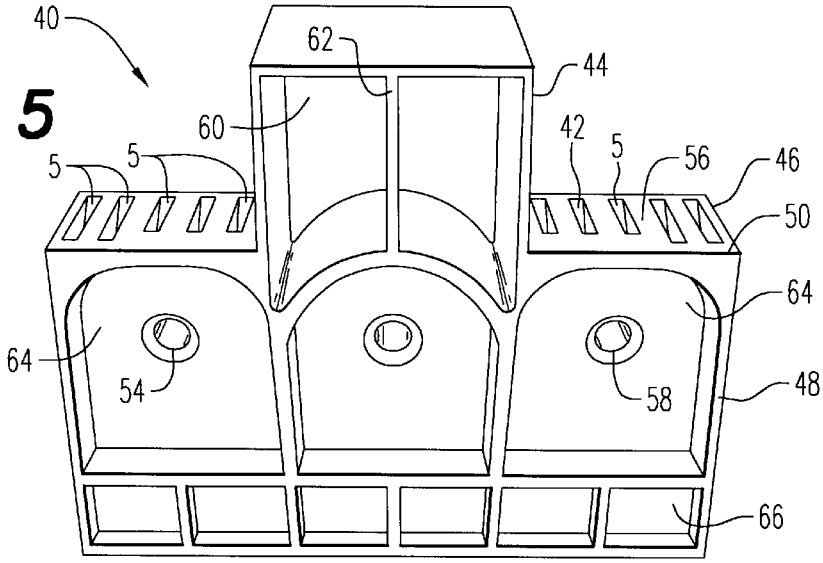
FIG. 5 is a top perspective view of the baseplate stabilizer of FIG. 4.
Figure 6:
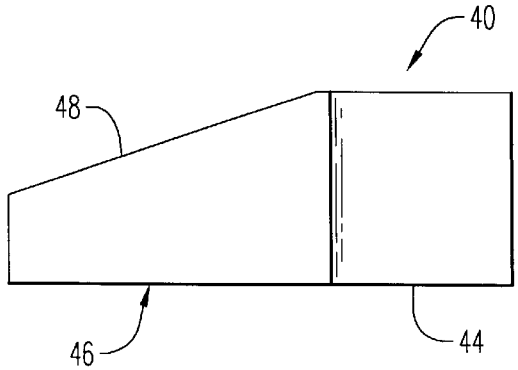
FIG. 6 is a side view of the baseplate stabilizer of FIG. 4.

With reference to FIGS. 4 through 6, it can be seen that baseplate stabilizer 40 preferably has an inverted T-shape with a substantially wedge-shaped support 42, one edge of which further defines a smaller rectangular toe portion 44. As viewed from a side as seen in FIG. 6, a lower surface 46 of baseplate stabilizer 40 provides a substantially level surface for engaging a similar level surface of the appropriate platform. The upper surface 48 of the wedge-shaped support 42 tapers upwardly to an edge wall 50. Toe portion 44 is integral with edge wall 50 and projects outwardly and from the edge of the wedge-shaped support 42. Toe portion 44 has substantially level upper and lower surfaces.

As seen in FIGS. 4 and 5, a plurality of apertures 54 and 55 are defined within the wedge-shaped support 42. Apertures 54 are surrounded by a sleeve or cylinder 56 of block material. Each aperture 54 provides communication between the upper surface 48 and the lower surface 46. Circular recesses or grooves 58 are defined on upper surface 48 surrounding some of apertures 54. The grooves 58 permit fasteners, for example wood screws (not pictured) to be countersunk relative to the adjacent block surface. Each aperture 55 is substantially linear and extends parallel relative to the other apertures 55. Apertures 55 are perpendicular relative to upper surface 48 and are angled relative to lower surface 46.

As seen in FIG. 5, the toe portion 44 comprises an open box. Toe portion 44 has a bottom surface and side walls forming a hollow cavity 60. A septum 62 extends through hollow cavity 60 from one side wall to support 42. All of the notches, webs and ribs provide rigidity to baseplate stabilizer 40, while reducing the amount of material required to form the stabilizer. Upper surface 48 also defines a series of shallow recessed regions 64 surrounding apertures 54, and a series of shallow notches 66 along the lower edge of upper surface 48.

As shown in FIG. 4, lower surface 46 defines a plurality of cavities 68 and a plurality of supporting webs or ribs 70. Ribs 70, along with the walls along the outer perimeter of the lower surface of baseplate stabilizer 40, define the engaging portions of lower surface 46. Some of the ribs 70 are co-extensive with cylinders 56 surrounding apertures 54. Each cylinder 56 is further supported by arcuate segments 72. A linear tab 74 extends between cylinder 56 and arcuate segments 72. Tabs 74 are integral with cylinder 56 and arcuate segment 72, providing additional strength and rigidity to cylinder 56.

The baseplate stabilizers 40 provide a method to improve the horizontal stability of wide web roll goods R in packaging systems according to the present invention during shipment and storage. Baseplate stabilizer 40 is inserted so that toe portion 44 engages, e.g., center notch 38 of end plate 10. Once positioned, a securing device such as a screw is inserted into each aperture 54 to secure the baseplate stabilizer 40 to the platform.

As disclosed in the parent application, L-shaped comer baseplate stabilizers 76 (see FIG. 3) can be used, alone or in conjunction with T-shaped baseplate stabilizers 40, to stabilize the end plates 10 of the present invention. The end plate, as well as the optional baseplate stabilizer, are preferably injection molded. Plastic materials such as polyethylene are preferred for their ability to generate uniform size and consistency. However, a wide variety of other plastics can be used. In addition, fiberglass, nylon, wood, metal or other suitable materials can also be used.

A preferred packaging system according to the present invention can be assembled as follows. Two end plates are placed facing one another, upright, with feet 12 turned inward, spaced apart slightly closer than the length of a core 24. Core 24 (typically containing roll goods R) is then lowered through channel 18 to stop 20. Horizontal members 28 are then placed in notches 26 to form a completed packaging system. Optionally, baseplate stabilizers 40 can be affixed to the platform and engage with center notch 38 to minimize movement of the packaging system. As seen in FIG. 3, a second packaging system can be assembled atop the first by placing two additional end plates directly above the first two and repeating the process.

Roll goods R suitable for use with the end plate 10 of the present invention include polymer films such as polyethylene terephthalate film, woven and non-woven fabrics, carpets, paper and other cellulose webs, laminated webs of various sorts, and so forth. In addition, the end plate 10 of the present invention can be used to transport numerous other items, including rigid, semi-rigid and flexible tubing, wires, cables or pipes, whether unsupported or mounted or wrapped about a core 24.

The elimination of the traditional pallet, and the reduction or elimination of lumber from a packaging system, enhances the cleanliness of the package. Contamination from the lumber is minimized. This is especially important in the polyester and plastics industry due to the static electricity the films generate. The static in the film attracts dust and dirt to the film surface. A preferred package comprising end plates of the present invention can be taken directly into a clean room environment after the dust cover that is wrapped about the roll goods during transportation or storage is removed.

Many obvious modifications of the foregoing are readily apparent to those of ordinary skill in the art. Having described the foregoing invention with reference to specific examples and embodiments thereof, the invention is not intended to be limited by such reference. The present invention shall include all obvious modifications thereof, as encompassed in spirit and scope by the appended claims.

What is claimed is:

1. A packaging system comprising:

an end plate for supporting roll goods having:

a vertical plate having a channel therethrough, said channel extending from a top edge of said vertical plate to a point separated from a bottom edge of said vertical plate; and a foot member extending from said vertical plate at said bottom edge, said foot member enhancing the stability of said end plate; and a core having an outer diameter less than or substantially equal to a width of said channel, such that said core can be lowered into said channel, further comprising a baseplate stabilizer adapted to engage a portion of said end plate.

2. The packaging system of claim 1, wherein said packaging system includes a notch in said botton edge.

3. The packaging system of claim 1, wherein said foot member is about ⅓ to about ⅙ the height of said end plate.

4. The packaging system of claim 1, wherein said packaging system is made of a polymeric material.

5. The packaging system of claim 1, further comprising at least one notch in said top edge adapted to accept a horizontal member.

6. The packaging system of claim 1, further comprising a web of polymer film disposed about said core.

7. The packaging system of claim 1, further comprising a second end plate stacked on top of said end plate.

8. The packaging system of claim 6, wherein said web is a wide web.

9. The packaging system of claim 1, wherein said top edge and said bottom edge have substantially equivalent widths to enable stable stacking.

10. The packaging system of claim 1, wherein said foot member extends substantially continuously across a width of said vertical plate.

11. The packaging system of claim 1, wherein said foot member includes a curved indentation on a top face thereof.

12. The packaging system of claim 1, wherein said foot member is tapered.

13. The packaging system of claim 1, wherein a ratio of a depth of said foot member to a depth of said end plate is about 1:1 to about 3:1.

14. The packaging system of claim 1, wherein said core has at least one open end.

15. The packaging system of claim 1, wherein said foot member projects from one face of said vertical plate only.

16. The packaging system of claim 1, wherein said packaging system does not include a supporting pallet.

17. The packaging system of claim 1, further comprising a second, substantially identical end plate, said core extending between said channel of said end plate and a channel of said second end plate.

18. A packaging system comprising:

an end plate for supporting roll goods having:

a vertical plate having a channel therethrough, said channel extending from a top edge of said vertical plate to a point separated from a bottom edge of said vertical plate; and a foot member extending from said vertical plate at said bottom edge, said foot member enhancing the stability of said end plate; and a core having an outer diameter less than or substantially equal to a width of said channel, such that said core can be lowered into said channel, further comprising at least one notch in said top edge of said end plate adapted to receive a horizontal member, and further comprising at least one horizontal member adapted for insertion into said at least one notch.

19. The packaging system of claim 18, wherein said top edge and said bottom edge have substantially equivalent widths to enable stable stacking.

20. The packaging system of claim 18, wherein said foot member extends substantially continuously across a width of said vertical plate.

21. The packaging system of claim 18, wherein said foot member includes a curved indentation on a top face thereof.

22. The packaging system of claim 18, wherein said foot member is tapered.

23. The packaging system of claim 18, wherein a ratio of a depth of said foot member to a depth of said end plate is about 1:1 to about 3:1.

24. The packaging system of claim 18, wherein said packaging system is formed with internal ribs.

25. The packaging system of claim 18, wherein said packaging system is formed by injection molding.

26. The packaging system of claim 18, wherein said packaging system is made of polyethylene.

27. The packaging system of claim 18, wherein said point is located approximately at and below a middle of said end plate.

28. The packaging system of claim 18, wherein said channel has two substantially parallel sides.

29. The packaging system of claim 18, wherein said end plate further includes interlocking elements enabling said end plate to interlock with a second end plate for stacking or storage.

30. The packaging system of claim 18, wherein said vertical plate is substantially perpendicular to said core when said core is lowered into said channel.

31. The packaging system of claim 18, comprising at least two substantially identical end plates.

32. The packaging system of claim 18, wherein said core has at least one open end.

33. The packaging system of claim 18, wherein said foot member projects from one face of said vertical plate only.

34. The packaging system of claim 18, wherein said channel ends in a curved stop.

35. The packaging system of claim 29, further comprising a second end plate inverted and removably affixed to said end plate by means of said interlocking elements.

36. The packaging system of claim 18, wherein said packaging system does not include a supporting pallet.

37. The packaging system of claim 18, wherein said core has no open end.

38. The packaging system of claim 18, further comprising a dust cover.

39. The packaging system of claim 18, further comprising a second, substantially identical end plate, said core extending between said channel of said end plate and a channel of said second end plate.

40. The packaging system of claim 39, further comprising a third substantially identical end plate stacked on said end plate, a fourth substantially identical end plate stacked on said second end plate, and a second core extending between a channel of said third end plate and a channel of said fourth end plate.

41. The packaging system of claim 39, wherein said packaging system conforms to roll goods of varying lengths by replacing said core with a core of different length.

42. The packaging system of claim 39, wherein said foot member keeps said vertical plates substantially perpendicular to said core.

43. The packaging system of claim 39, wherein said core extends beyond said vertical plate of said end plate.

44. The packaging system of claim 39, wherein said core is shorter than a distance between said vertical plate and a vertical plate of said second end plate.

45. The packaging system of claim 39, wherein said packaging system further comprises a holding means selecting from the group consisting of strapping and banding.

46. The packaging system of claim 18, wherein said packaging system further comprises a holding means selecting from the group consisting of strapping and banding, and said holding means passes through said notch.

47. The packaging system of claim 32, wherein said open end is adapted to receive a forklift rail.

48. A packaging system comprising:

an end plate for supporting roll goods having:

a vertical plate having a channel therethrough, said channel extending from a top edge of said vertical plate to a point separated from a bottom edge of said vertical plate; and a foot member extending from said vertical plate at said bottom edge, said foot member enhancing the stability of said end plate; and a core having an outer diameter less than or substantially equal to a width of said channel, such that said core can be lowered into said channel, further comprising an L-shaped corner baseplate stabilizer.

* * * * *